US005156346A

United States Patent [19]

Portz

[11] Patent Number: 5,156,346

[45] Date of Patent: Oct. 20, 1992

[54] MOBILE SHREDDER

[76] Inventor: W. Lyle Portz, 2509, 221 - 6th Avenue, S. E., Calgary, Alberta, Canada, T2G 4Z9

[21] Appl. No.: 758,610

[22] Filed: Sep. 12, 1991

[51] Int. Cl.[5] ..... B02C 23/02

[52] U.S. Cl. ..... 241/222; 198/671; 241/260.1

[58] Field of Search ..... 241/222, 260.1; 198/497, 499, 671

[56] References Cited

U.S. PATENT DOCUMENTS

| | | | |
|---|---|---|---|
| 2,626,159 | 1/1953 | Thompson | 241/222 X |
| 4,167,825 | 9/1979 | Gee et al. | 198/671 X |
| 4,438,885 | 3/1984 | Martin | 241/160.1 X |
| 4,881,855 | 11/1989 | Rempel et al. | 198/671 X |

*Primary Examiner*—Douglas D. Watts
*Attorney, Agent, or Firm*—George A. Seaby

[57] ABSTRACT

In general, paper shredders cut paper into narrow strips, and for such purpose, include narrow, somewhat delicate blades. A paper spreader for receiving shredded paper from a shredder, and compacting and cutting the paper into smaller pieces before distributing the paper pieces to a pile includes an outlet chute for receiving shredded paper from a shredder, an auger inclined upwardly and outwardly from the chute for compacting and conveying shredded paper away from the shredder, a deflector plate at the outer top end of the auger for deflecting paper carried by the auger, and a blade on the deflector plate extending tangentially of the auger shaft for cooperating with a sharpened, upwardly tapering auger flight to shear the paper carried by the auger.

7 Claims, 2 Drawing Sheets

MOBILE SHREDDER

BACKGROUND OF THE INVENTION

1. Field of the Invention

This invention relates to a spreader device for use in combination with a paper shredder.

More specifically, the invention relates to a device for cutting, mixing, compacting and spreading strips of paper discharged from a paper shredder.

2. Discussion of the Prior Art

Paper shredders usually include a series of rotating cutting tools for shredding paper into thin strips. Ideally the strips are so thin that they cannot readily be reassembled to form a readable sheet. Obviously, the thinner the strips, the less the likelihood that they can be reconstructed to form the original sheet. However, the cutting of very thin strips requires thin cutting tools, which are fragile and somewhat inefficient.

A solution to the problem is the use of a multistage shredder for slicing paper into strips and dicing the strips. Devices of this type are described in U.S. Pat. No. 4,068,805, issued to F. Oswald on Jan. 17, 1978, and U.S. Pat. No. 4,124,169, issued to Takefumi Hatanaka on Nov. 7, 1978. However, the patented devices are somewhat complicated, including a large number of moving parts. Therefore, such apparatus would be expensive to produce and in al likelihood require frequent maintenance. Moreover, neither device provides any means for removing shredded paper from the vicinity of the shredder.

GENERAL DESCRIPTION OF THE INVENTION

The object of the present invention is to provide a solution to the above problems in the form of a relatively simple spreader device for use with a paper shredder which removes shredded paper from the shredder, and which further processes the paper to make it more difficult to reassemble the pieces into a coherent whole.

Accordingly, the present invention relates to a paper spreader device for use in combination with a paper shredder comprising outlet chute means on the paper shredder for receiving shredded paper; auger means extending upwardly and outwardly from said chute means for conveying the shredded paper away from said chute means; and blade means proximate the outer end of said auger means for cutting the shredded paper from said auger means, whereby the shredded paper is removed from auger means for gravity distribution over an area beneath the outer end of said auger means.

BRIEF DESCRIPTION OF THE DRAWINGS

The invention will be described in greater detail with reference to the accompanying drawings, which illustrate a preferred embodiment of the invention, and wherein.

DESCRIPTION OF PREFERRED EMBODIMENT

With reference to the drawings, the spreader device of the present invention includes an arcuate chute 1 of semicircular cross section mounted on the lower discharge end of a conventional paper shredder 2. The shredder 2 is an off-the-shelf piece of hardware which is intended to shred paper into thin strips (not shown). The chute 1 extends outwardly from beneath the shredder 2 for collecting the strips of pager discharge from the shredder.

Figure 1:
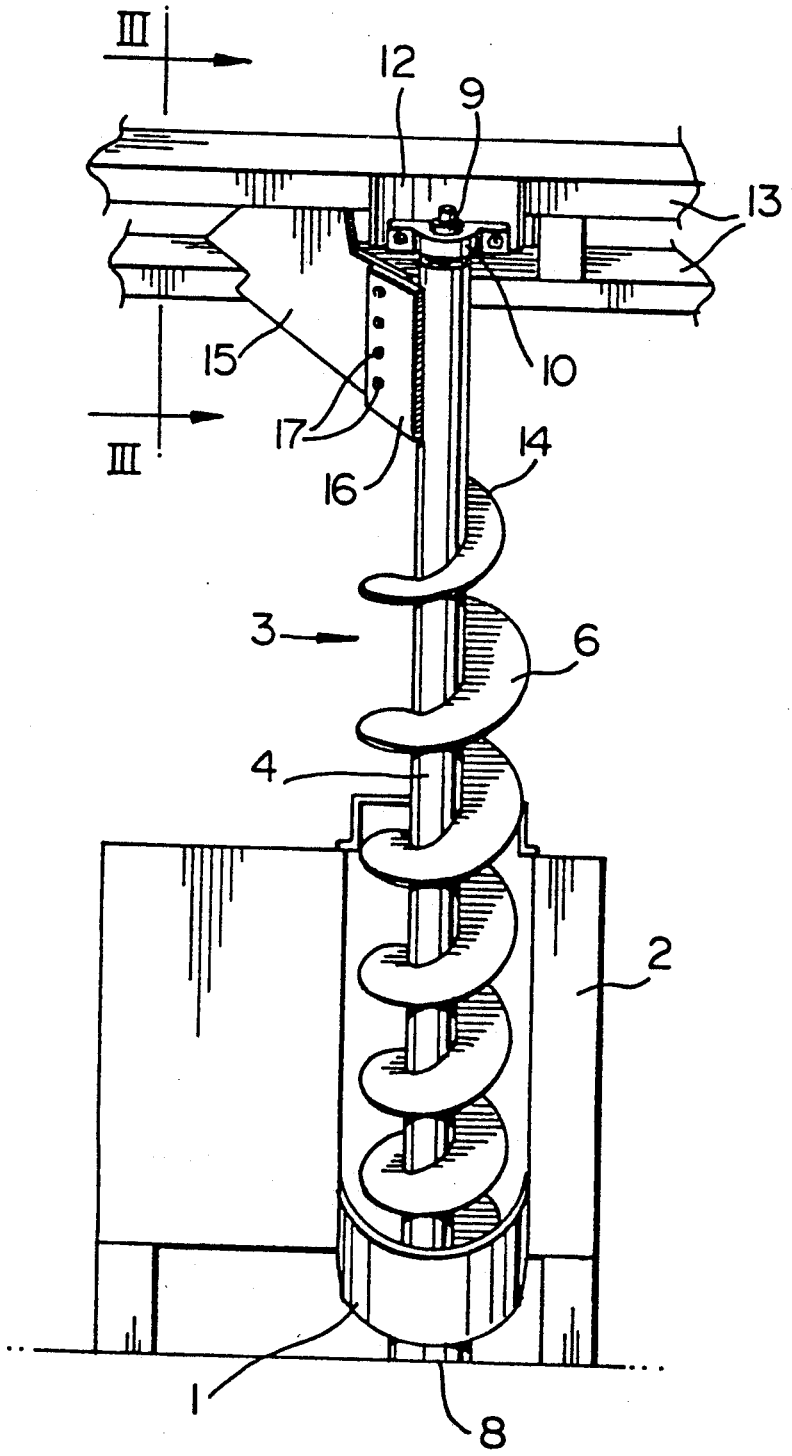
FIG. 1 is a perspective view of a spreader device in accordance with the present invention.
Figure 4:
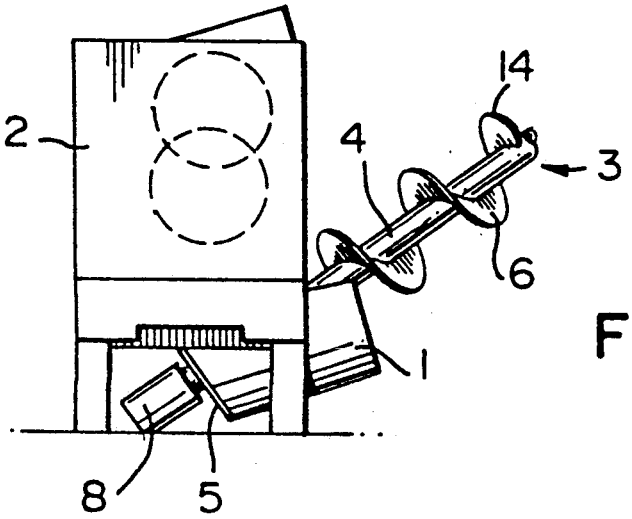
FIG. 4 is a side view of the lower end of the device of FIG. 1.

An auger generally indicated at 3 extends upwardly and outwardly from the chute 1 for conveying shredded paper away from the shredder 2. In order to achieve a certain degree of wadding of the already shredded paper, the auger 3 is rotated at a slower speed than the discharge rate of the shredder 2. The preferred angle of the auger is 37° to the horizontal. The auger 3 includes an elongated shaft 4 extending through a lower end wall 5 (FIG. 4) of the chute 2 and a helical flight 6. The shaft 4 and the flight 6 are rotated by a motor 8 connected to the bottom end of the shaft. The upper end 9 of the shaft 4 rotates in a pillow block bearing 10, which is mounted on a plate 12 (FIG. 1) extending downwardly from a beam 13. A pair of beams 13 are mounted in a truck (not shown) or other vehicle when the shredder/distribution device combination is to be portable. For a fixed installation, the beams 13 are mounted in a large container, which houses the shredder 2. The outer edges 14 of the auger flight 6 are sharpened for facilitating additional shredding of the already shredded paper.

Figure 2:
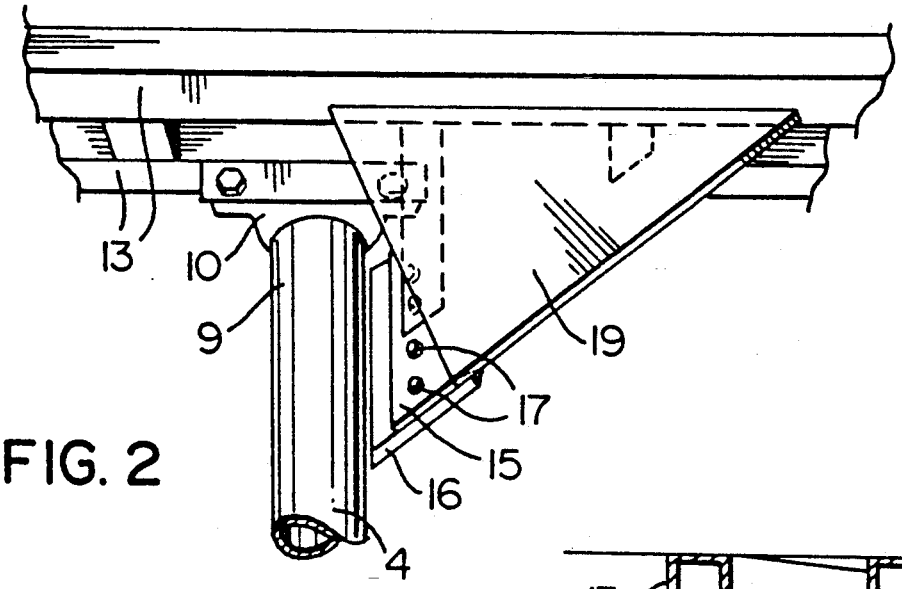
FIG. 2 is a perspective view of the top end of the device of FIG. 1 from the side opposite FIG. 1.
Figure 3:
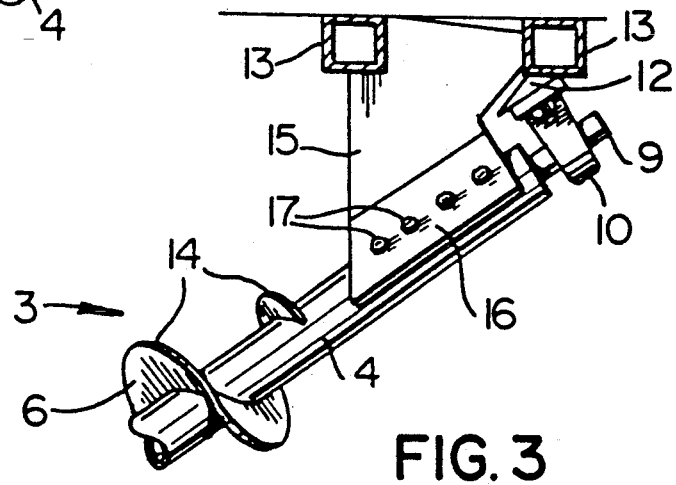
FIG. 3 is a cross section taken generally along line III—III of FIG. 1.

A deflector plate 15 is connected to and extends downwardly from the beams 13 to a position adjacent the auger 3. A blade 16 is attached to the lower end of the plate 15 by bolts 17. The blade 16 is approximately tangential to the auger 3. The upper end of the auger flight 6 is tapered, and the outer edge 18 thereof is sharpened so that there is a shearing action between the flight 6 and the blade 16. Thus, the already shredded paper is cut into smaller pieces as it is sheared from the auger while the tapered and sharpened flight cuts wadded material in a scissor-like manner. The finely shredded paper falls to form a pile (not shown) beneath the upper end of the auger 3. Shredded paper rising on the auger into contact with the blade 16 and the plate 15 is compacted in the area between the plate 15 and a reinforcing plate 19 (FIG. 2) extending downwardly from one beam 13 to one edge of the plate 15.

Because the device of the present invention effects additional chopping and mixing of the paper, it is not necessary that the shredder cut the paper into very thin strips. Therefore, wider and stronger cutting tools can be used, making the shredder more productive and efficient.

We claim:

1. A paper spreader device for use in combination with a paper shredder comprising outlet chute means on the paper shredder for receiving shredded paper; auger means extending upwardly and outwardly from said chute means for conveying the shredded paper away from said chute means; and blade means proximate the outer end of said auger means for cutting the shredded paper from said auger means, whereby the shredded paper is removed from auger means for gravity distribution over an area beneath the outer end of said auger means.

2. A device according to claim 1, wherein said auger means includes shaft means; and helical flight means on said shaft means, at least the outer end of said flight means being sharp to define a cutting edge for preventing accumulation of shredded paper on said auger means and for cutting the shredded paper into small pieces.

3. A device according to claim 2, wherein said flight means tapers towards the outer end thereof to facilitate shearing action between said auger means and said blade means.

4. A device according to claim 3, wherein said auger means is inclined by an angle of approximately 37 to the horizontal.

5. A device according to claim 3, including deflector plate means carrying said blade means for deflecting shredded paper from said auger means.

6. A device according to claim 5, wherein said blade means is parallel to the longitudinal axis of said auger shaft means, said blade means extending substantially tangentially of said shaft means.

7. A device according to claim 6, wherein said chute means is arcuate, extending around the bottom end of said auger means for feeding shredded paper to said auger means.

* * * * *